US005349140A

United States Patent [19]

Valenzin

[11] Patent Number: 5,349,140

[45] Date of Patent: Sep. 20, 1994

[54] MICROPHONE WINDSCREEN

[76] Inventor: Lawrence R. Valenzin, 3130 Berkshire Ct., Pleasanton, Calif. 94588

[21] Appl. No.: 926,911

[22] Filed: Aug. 7, 1992

[51] Int. Cl.[5] ..... G10K 13/00

[52] U.S. Cl. ..... 181/158; 181/242; 381/189

[58] Field of Search ..... 181/21, 158, 166, 169, 181/171, 242; 381/91, 169, 188, 189

[56] References Cited

U.S. PATENT DOCUMENTS 2,623,957 12/1952 Cragg et al. ..... 181/242
4,057,124 11/1977 Braden ..... 181/242
4,401,859 8/1983 Watson ..... 181/158 X
4,410,770 10/1983 Hagey ..... 181/158 X
4,887,693 12/1989 Plice ..... 181/242

*Primary Examiner*—Michael L. Gellner
*Assistant Examiner*—Khanh Dang

[57] ABSTRACT

A windscreen for a remote microphone for mobile radios is disclosed. The sound absorbent material is held in place on the exterior surface of the microphone housing by means which permit easy detachment from the housing, thereby permitting replacement as the sound absorbent material deteriorates with age and exposure to the elements.

4 Claims, 1 Drawing Sheet

MICROPHONE WINDSCREEN

BACKGROUND OF THE INVENTION

1. Field of the Invention

The present invention relates generally to an improved microphone windscreen and more particularly to windscreens for remote microphones on two-way radios used by policemen and trainmen on moving vehicles.

2. Prior Art

A problem common to all microphones is the existence of substantial noise produced from air passage over the microphone's surface. Noise produced by wind passage over the microphone is commonly referred to as "puff", and noise produced by the passage of a person's breath over the surface of the microphone is commonly referred to a "pop". In the prior art, numerous methods have been employed to protect against both puff and pop, including the placement of windscreens or porous materials over the surface the microphone to reduce the interaction between the moving air and the microphone's surface.

There are several prior art schemes that have been employed in an attempt to eliminate or reduce microphone wind noises. One is the use of a foam "sock" which is pulled over the microphone head. However, foam socks tend to deteriorate over time. As a result, foam particles often fall into the microphone head, causing damage and reduce performance. Also, foam socks suffer the drawback of only being effective to reduce wind noise due to very slight breezes, to approximately three miles per hour. This is a severe limitation particularly when using remote microphones attached to the lapel or collar of persons riding on moving vehicles such as trains or motorcycles and attempting to use two-way radios.

Various other schemes have been tried such as those shown in U.S. Pat. Nos. 4,887,693 and 4,966,252. The solutions shown in these patents require entirely new microphone housings.

OBJECTS OF THE INVENTION

Accordingly, it is an object of this invention to provide an improved windscreen to protect a remote microphone from noise created by air passing over the surface thereof.

Another object of this invention is to provide an improved windscreen that can be readily applied to existing remote microphones without the necessity to redesign the microphone housing.

Another object of the present invention is to provide an improved windscreen that is simple and inexpensive to fabricate.

A still further object of this invention is to provide an improved windscreen that can be easily and economically replaced.

SUMMARY OF THE INVENTION

These and other objects of the invention are accomplished by providing a windscreen made of a sound absorbent material which has broad frequency band absorption characteristics and a high rate of attenuation of sound waves travelling through it which can be easily applied and removed from the face of housings that are presently in use for remote microphones of two-way radios. Several means are possible for affixing the windscreen to the microphone housing. Two of the simpler means are the use of Velcro fasteners or plastic channels. Suitable sound absorbent materials are well known in the art and comprise polyurethane foam, foamed polystyrene, non-woven fabric and the like. The sound absorbent material is applied to the mating Velcro material or a sheet of stiff material that can slide within the plastic channels.

DETAILED DESCRIPTION OF THE INVENTION

Figure 1:
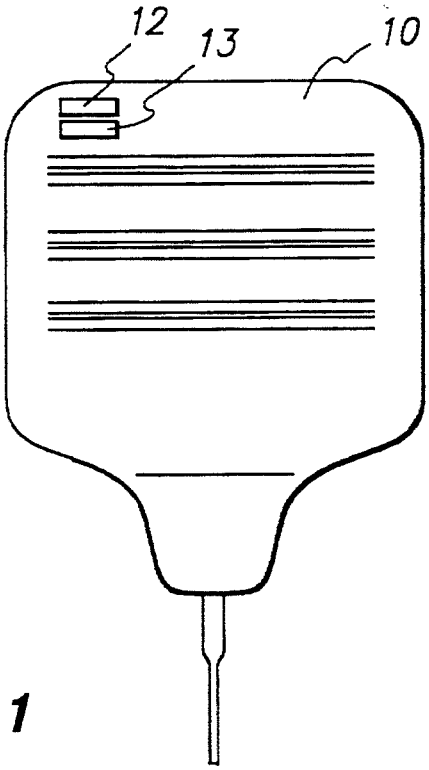
FIG. 1 is a plan view of a common type of remote speaker/microphone housing currently in use with portable two-way radios.
Figure 2:
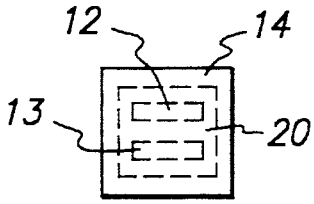
FIG. 2 is a plan view of a portion of such housing showing the channels leading to the microphone and illustrating the preferred embodiment of the present invention.
Figure 4:
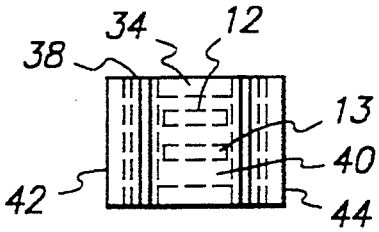
FIGS. 4 and 5 are plan and cross section views of a further embodiment of the invention corresponding to FIGS. 2 and 3, respectively.
Figure 3:
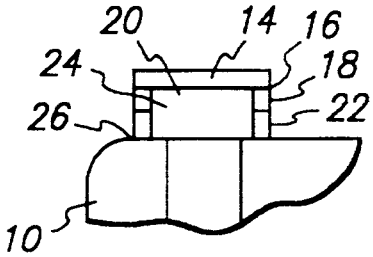
FIG. 3 is a cross-section view of the embodiment shown in FIG. 2.
Figure 5:
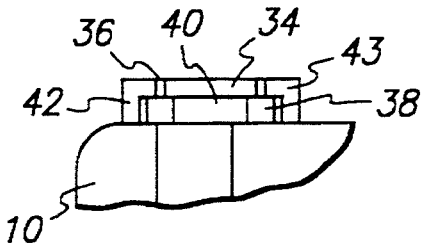

Referring now to the drawings, FIG. 1 shows a common construction of a combination speaker and microphone housing 10 currently employed for a remote use with a two-way radio and in which the housing has openings 12 and 13 therein which are the outlet of a channel which leads to a microphone inside the housing. FIGS. 2 and 3 show the preferred embodiment of the windscreen of the present invention in which the sound absorbent material 14 is applied by a layer of adhesive 16 to one side of a Velcro fastener 18 which has had an opening 20 removed from the center thereof which exceeds the size of the openings 12 and 13 in the housing 10. The other side of the Velcro fastener 22 which has also had an opening 24 removed from the center thereof is attached to its mate 18. This windscreen can be attached to the microphone housing by means of a further adhesive layer 26.

A further embodiment is shown in FIG. 3 in which the sound absorbent material 34 is applied by a layer of adhesive 36 to one side of a piece of thin plastic sheeting 38 which has an opening 40 removed from the center thereof which exceeds in size the openings 12 and 13 in the housing 10. Two upside down L-shaped channels 42 and 43 are affixed to opposite side of the openings 12 and 13 on the surface of the housing 10 in spaced apart relationship so that the thin plastic sheeting 38 with the sound absorbent material 34 applied thereto can slide in and out of the channels, thus holding it over the openings 12 and 13.

When the sound absorbent material 14 or 34 ages and before beginning to deteriorate, either can be easily removed from the housing and another piece of sound absorbent material 14 or 34 and its respective backing 18 or 38 can be substituted therefor.

While any of the well known sound absorbent materials can be utilized to practise this invention, one commercially available in sporting goods stores as tape for fishing rods is particularly suitable. More particularly, it appears that the most desireable sound absorbent material is one that has a porosity which permits a column of water 25 centimeters high to pass through a piece of material one centimeter in diameter in approximately three to six seconds.

In order to protect the sound absorbent material and the microphone from rain or snow it is preferred to spray a water repellent liquid, such as silicone, on the sound absorbent material before putting the windscreen into service. A suitable water repellent is commercially available as Scotch Guard manufactured by 3M Corporation.

While the preferred embodiment of the present invention has been set forth in the above detailed description, it is to be understood that the preferred embodiment is only one example of the invention. Other modifications may be used without departing from the scope of the present invention. The invention is only limited by the following claims, including equivalents where appropriate.

What is claimed is:

1. A windscreen for a remote microphone used for a mobile two-way radio in which said microphone is imbedded in a microphone housing having an exterior surface, a microphone located within said housing, and a channel between said microphone and the exterior surface of said housing said channel thereby forming an opening in said exterior surface of the housing which windscreen comprises the combination of a sound absorbent material which is a foamed plastic, a Velcro affixed to said sound absorbent material and a mating Velcro fastener affixed to the exterior surface of a microphone housing surrounding the opening in the exterior surface of a microphone housing, said Velcro and said mating Velcro fastener cooperating to retain the sound absorbent material in a demountable fashion over the opening in the exterior surface of a microphone housing formed by the channel leading from the exterior surface of the housing to the microphone.

2. A windscreen in accordance with claim 1 in which the sound absorbent material has a permitisity such that a column of water 25 centimeters high and 1 centimeter in diameter will pass through a 1 centimeter diameter piece of sound absorbent material in between 3 and 6 seconds.

3. A windscreen in accordance with claim 1 in which the sound absorbent material has a layer of water repellent material on the surface thereof.

4. A windscreen in accordance with claim 3 in which the water repellant material is a silicone.

* * * * *